United States Patent [19]

Hoffman, Jr.

[11] Patent Number: 4,793,632

[45] Date of Patent: Dec. 27, 1988

[54] AUTOMATIC BOOKMARK AND PAGE HOLDING DEVICE

[76] Inventor: Henry R. Hoffman, Jr., 4201 Spring Valley Rd., Ste. 333, Dallas, Tex. 75244

[21] Appl. No.: 934,024

[22] Filed: Nov. 24, 1986

[51] Int. Cl.[4] ..... B42D 9/00; B42D 9/06; E05D 15/00

[52] U.S. Cl. ..... 281/42; 116/238; 16/363

[58] Field of Search ..... 281/42, 45, 46, 49; 116/233, 234, 235, 236, 237, 238, 239, 240; D19/34; 24/81, 67.5; 16/363

[56] References Cited

U.S. PATENT DOCUMENTS

| | | | |
|---|---|---|---|
| 284,404 | 9/1883 | Foote . | |
| 461,341 | 10/1891 | Johnson . | |
| 512,747 | 1/1894 | Platt . | |
| 563,381 | 7/1896 | Judd . | |
| 704,410 | 7/1902 | Weaver . | |
| 840,475 | 1/1907 | Conter . | |
| 854,873 | 5/1907 | Conter . | |
| 875,502 | 12/1907 | Chadwick . | |
| 898,669 | 9/1908 | Moore et al. . | |
| 1,150,678 | 8/1915 | Heazlewood . | |
| 1,346,856 | 7/1920 | Sprague . | |
| 1,438,299 | 12/1922 | Conter . | |
| 1,469,163 | 9/1923 | Mallina . | |
| 1,540,777 | 6/1925 | Hellerman . | |
| 1,646,291 | 10/1927 | Horacek . | |
| 1,676,644 | 7/1928 | Faulken . | |
| 1,700,846 | 2/1929 | Klein | 116/237 |
| 1,712,137 | 5/1929 | Curti | 281/42 |
| 1,847,184 | 3/1932 | Hellerman . | |
| 1,862,573 | 6/1932 | Grosz . | |
| 1,937,442 | 11/1933 | Scognamillo | 281/42 |
| 2,387,607 | 10/1945 | Pascoo | 116/119 |
| 2,435,886 | 2/1948 | Hayes | 116/238 |
| 2,436,609 | 2/1948 | Safier | 116/239 |
| 2,442,708 | 6/1948 | Pascoo | 116/119 |
| 2,449,211 | 9/1948 | Forsyth | 116/119 |
| 2,610,074 | 9/1952 | Meyers | 281/42 |
| 2,778,331 | 1/1957 | Solis Bonilla | 116/119 |
| 2,837,802 | 6/1958 | Genco | 24/66 |
| 3,016,036 | 1/1962 | Jorgensen | 281/42 |
| 3,158,131 | 11/1964 | Salayka | 116/119 |
| 4,285,532 | 8/1981 | Davis | 281/42 |
| 4,487,156 | 12/1984 | Frost | 116/239 |

FOREIGN PATENT DOCUMENTS

| | | | |
|---|---|---|---|
| 658705 | 3/1938 | Fed. Rep. of Germany | 281/42 |
| 243533 | 1/1947 | Switzerland | 16/363 |
| 143662 | 6/1920 | United Kingdom | 16/363 |
| 406765 | 3/1934 | United Kingdom | 116/237 |

*Primary Examiner*—E. R. Kazenske
*Assistant Examiner*—Paul M. Heyrana
*Attorney, Agent, or Firm*—Richards, Harris, Medlock & Andrews

[57] ABSTRACT

A bookmark and page holding device is provided for automatically holding and marking a page of a book. A spring clip attaches the bookmark to the rear cover of a book. A spring-loaded swing arm is pivotally attached to the spring clip at one end and has a page holder plate pivotally attached to the other end. As the book page is turned, the page holder plate pivots up and away from the page, allowing the page holder plate to return to the next page under the action of the spring-loaded swing arm. In one embodiment, the page holder has an arcuate, inwardly curving edge for engaging the edge of the turned page to facilitate its use with lightweight paper. The page holder plate marks the last page being read when the book is closed as well as when opened.

10 Claims, 2 Drawing Sheets

FIG. 1
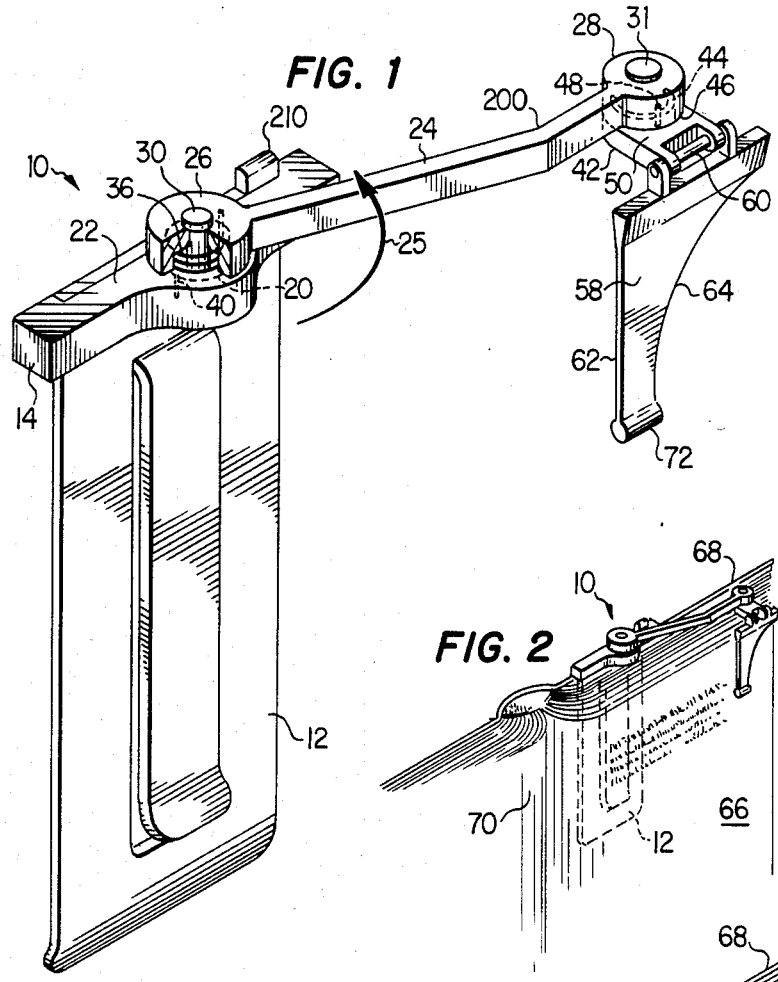
FIG. 2
FIG. 3
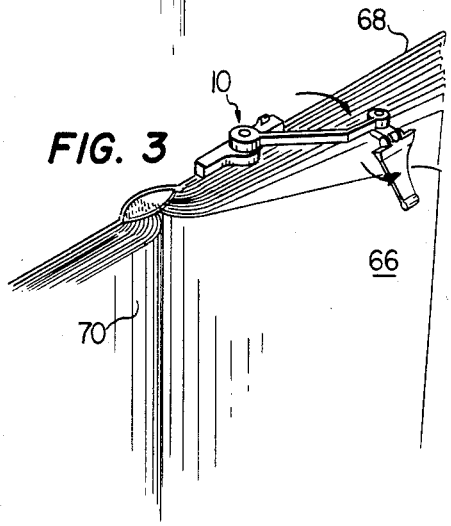

AUTOMATIC BOOKMARK AND PAGE HOLDING DEVICE

TECHNICAL FIELD

This invention relates to bookmarks and page holding devices, and in particular to an automatic bookmark and page holding device.

BACKGROUND ART

Bookmarks have typically provided a method for marking a page in a book and/or holding a book open to a particular location. Differences in the size of books and the types of materials used in construction (hardback versus paperback, thin versus thick, heavy paper versus light paper, etc.) present a problem in finding one bookmark that is suitable for use with most types of books.

Some bookmarks, such as U.S. Pat. No. 704,410, issued July 8, 1902, to C. P. Weaver, and U.S. Pat. No. 1,438,299, issued Dec. 12, 1922, to M. J. Conter, are suitable for use with a hardback book but are not usable with paperback books. Other bookmarks, such as U.S. Pat. No. 840,475, issued Jan. 8, 1907, to M. J. Conter, may be suitable for pages made from a heavyweight paper, but would be unsuitable for use with a lightweight paper. In addition, bookmarks have been made with special widening procedures to accommodate books of varying book thicknesses, such as U.S. Pat. No. 1,700,846, issued Feb. 5, 1929, to B. Klein, and U.S. Pat. No. 2,436,609, issued Aug. 16, 1946, to A. Safier. A need thus exists for a bookmark that automatically marks the page in a book as each page is turned and that is suitable for use with books of varying size and materials of construction.

SUMMARY OF THE INVENTION

The bookmark of the present invention automatically marks the page of a book upon the reader's action of turning a page and is suitable for use with books of varying thickness and with pages of varying paper weight.

The bookmark has a clip which may be used for mounting to the rear cover of a paperback or hardbound book. The clip has a spring-loaded swing arm attached to it by a yoke. On the end of the swing arm distal from the clip is a second yoke and a spring-loaded or weighted page holder. In one particular embodiment, the page holder includes an arcuate, inwardly curving, edge for engaging the edge of a turned page.

In use, the bookmark is clipped to the rear cover of a book. The spring-loaded swing arm is then positioned so that the spring-loaded or weighted page holder rests on the right-hand page of the open book As each right-hand page is turned, the page holder pivots up and away from the page. After the page has been turned, the page holder pivots back down onto the next page. The spring-loaded swing arm maintains the page holder in engagement with the page and provides a means for accommodating books of various thicknesses and automatically adjusting to the varying distance between the page holder and the rear cover. When the book is closed the page holder marks the reader's place.

DESCRIPTION OF THE DRAWINGS

For a more complete understanding of the present invention and for further advantages thereof, reference is now made to the following Description of the Preferred Embodiment taken in conjunction with the accompanying Drawings in which:

FIG. 1 is a perspective, partially exploded view of the present invention;

FIG. 2 is a perspective view of the present invention marking a page of an open book;

FIG. 3 is a perspective view of the present invention as a page of the book is turned;

DESCRIPTION OF THE PREFERRED EMBODIMENTS

Figure 4:
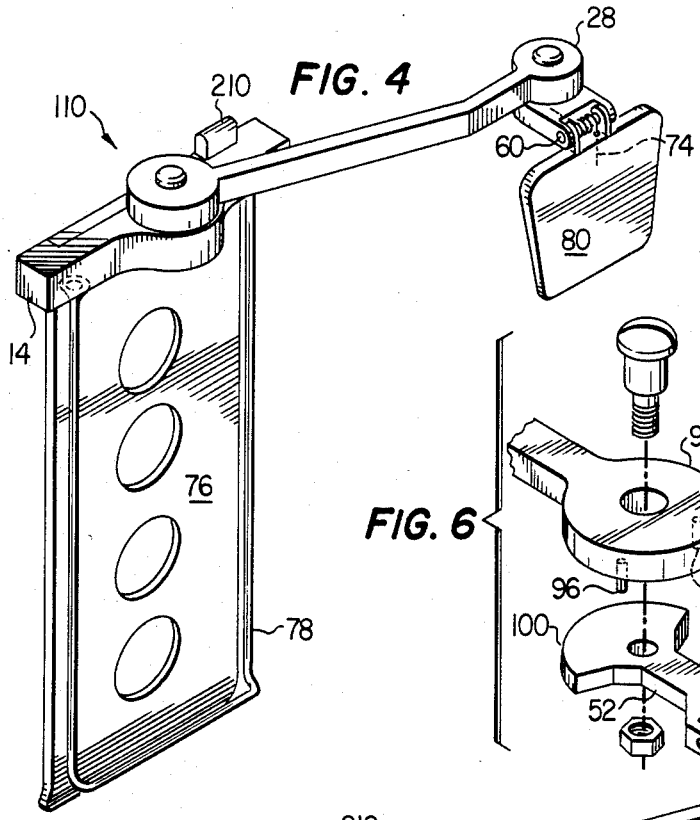
FIG. 4 is an alternate embodiment of the present invention.

Referring to FIG. 1, an automatic bookmark and page holding device of the present invention is generally identified by reference numeral 10. A spring clip 12 provides a means to attach automatic bookmark 10 to a rear cover 68 of a book 70 (FIG. 2). A first yoke 14 is secured to spring clip 12 by any appropriate means, such as using fasteners, adhesives, or as an integral part of a plastic molding, and the first yoke 14 has a milled or molded cavity 20 in its top surface 22.

A spring-loaded swing arm 24 has a first end 26 proximate to the yoke 14 and a second end 28 distal from the yoke 14. The first end 26 of spring-loaded swing arm 24 has a milled or molded cavity 36 in its bottom surface 38 to be aligned with the milled or molded cavity 20 in the top surface 22 of first yoke 14. A spring 40 is secured within first milled cavity 20 and within the milled cavity 36 for biasing the swing arm 24 in the direction shown by arrow 25. The spring-loaded swing arm 24 is pivotally mounted to the top surface 22 of first yoke 14 by any appropriate means, such as a pin 30, or a bolt and nut with or without washers, or a collared bolt and nut of appropriate material. The top surface 22 of first yoke 14 has a raised stop 210 which serves to limit the rotation of the spring-loaded swing arm 24 in the direction shown by arrow 25. Swing arm 24 may have a bend 200 to allow full access of the page holder.

The spring-loaded swing arm 24 may be slideably adjustable along its longitudinal axis. The swing arm 24 may have one male section for receiving a second female section and a nut and bolt arrangement for selecting the desired length to accommodate different page sizes.

A second yoke 42 is pivotally mounted to the second end 28 of spring-loaded swing arm 24 by any appropriate means, such as a pin 31, or a bolt and nut with or without washers, or a collared bolt and nut of appropriate material. The second end 28 has a groove 44 cut into its underside 46. The second yoke 42 has a pin 48 extending from its top side 50 and. . positioned so as to travel within groove 44, thus providing a means to allow yoke 42 to rotate a certain distance about pin 31.

A page holder plate 58 is attached to a spring bar 60 journaled for rotation within the second yoke 42 to allow the plate 58 to pivot on the spring bar 60. The page holder plate 58 has straight side 62 and an arcuate, inwardly curving, side 64 proximate the right hand edge of a page. The arcuate side 64 guides a page 66 as it is being turned, as seen at FIG. 3, facilitating the use of the bookmark 10 with lightweight paper pages. A weight 72 or a coiled spring member 74 (FIGS. 4 and 5) may be attached to the page holder plate 58 to help mark and hold page 66 as seen in FIG. 2. The bookmark 10 may be constructed of any suitable material, as molded plastic or metal parts.

Figure 5:
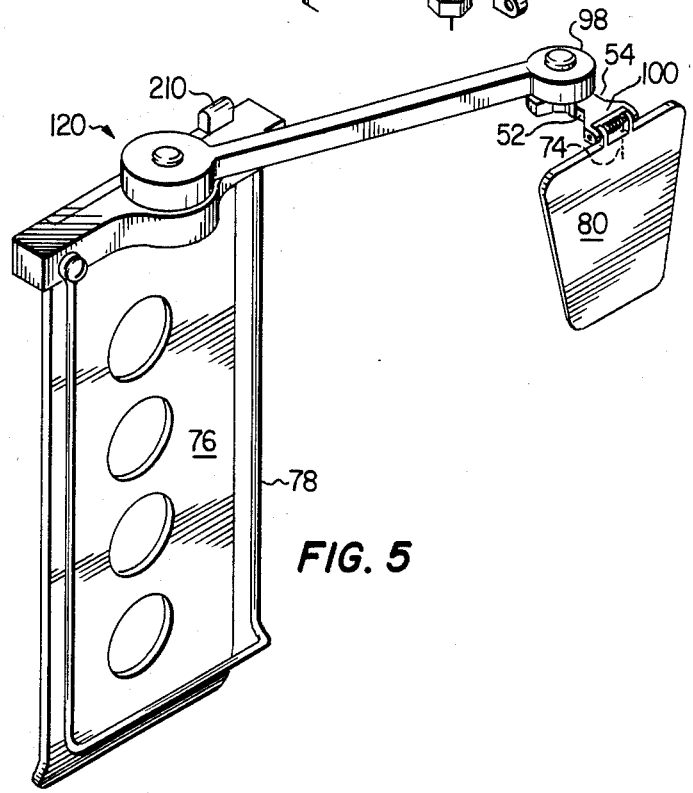
FIG. 5 is yet another embodiment of the present invention.

Referring to FIGS. 4 and 5, alternate embodiments of the present invention are generally identified by the reference numerals 110 and 120. It is to be understood, that the bookmarks 110, 120 are constructed in a like manner to bookmark 10, except as shown otherwise in FIGS. 4 and 5 and described herein.

The bookmarks 110, 120 have a plate 76 and a U-shaped spring wire 78 attached thereto as an alternate means of securing the bookmark to the rear cover of a book.

Figure 6:
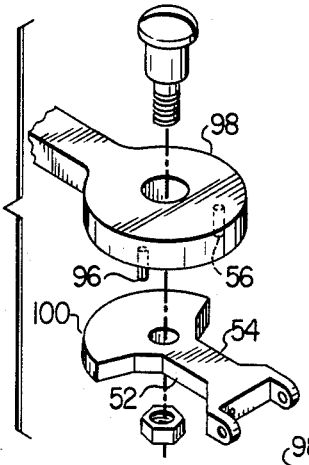
FIG. 6 is a perspective, partially exploded view of FIG. 5.

The bookmark 110 has a generally rectangular page holder 80 and includes a coiled spring member 74 positioned about the bar 60 to bias page holder 80 toward the right hand page of a book. Referring to FIG. 5, swing arm 24 has a second end 98. Second end 98 has a planar surface. Second yoke 100 has oppositely facing notched portions 52 and 54. Projecting out from the planar surface of second end 98 so as to coincide with notched portions 52 and 54 are first pin 56 and second pin 96. Referring to FIG. 6, it can be seen that the range of pivotal motion of second yoke 100 is limited on one extreme limit where first pin 56 contacts notched portion 54 and on the other extreme limit where second pin 96 contacts notched portion 52.

Although the present invention has been described with respect to a specific preferred embodiment thereof, various changes and modifications may be suggested to one skilled in the att and it is intended that the present invention encompass such changes and modifications as fall within the scope of the appended claims.

I claim:

1. A bookmark and page holding device comprising:

a means for attachment to a book;

a swing arm having a first end pivotally connected to said means for attachment, said first end being pivotable about a first axis, said swing arm also having a second end distal to said first end;

means for spring-loading said swing arm relative to said means for attachment;

a yoke having a first end pivotally connected to said second end of said swing arm, said yoke being pivotable about a second axis, said second axis lying parallel to and co-planar with said first axis, said yoke also having a second end distal to said first end of said yoke, and said yoke being limited in its pivotable movement relative to said second end of said swing arm by a rotation limiting means; and a page holder plate pivotally connected to said second end of said yoke, said page holder plate being pivotable about a third axis being perpendicular to said second axis and lying in a plane parallel to said plane defined by the page tops of said book, wherein said rotation limiting means comprises a pin extending from a surface of said yoke adjacent said swing arm and a groove formed in a side of said second end of said swing arm adjacent said yoke for receiving said pin, whereby said page holder's rotational movement in the plane of said swing arm is limited by the length of said groove in which said pin travels.

2. The bookmark and page holding device of claim 1, wherein said means for attachment to a book is a spring clip.

3. The bookmark and page holding device of claim 2, wherein said spring clip is a single piece of molded plastic.

4. The bookmark and page holding device of claim 2, wherein said spring clip comprises:

a backplate; and a spring wire attached to said back plate, whereby a book cover is clamped between said back plate and said spring wire.

5. The bookmark and page holding device of claim 1, wherein said swing arm is limited in its pivotally biased movement by a stop on said means for attachment to a book.

6. The bookmark and page holding device of claim 1, wherein said page holder plate comprises:

a first edge proximal to said means for attachment, said first edge parallel to said first axis and said second axis; and a second edge distal to said means for attaching said second edge having an arcuate surface curved inwardly toward said first edge.

7. The bookmark and page holding device of claim 1, wherein a weight is disposed on said page holder plate at an end of said page holder plate distal to said yoke.

8. The bookmark and page holding device of claim 1, wherein said page holding plate is spring-loaded relative to said yoke.

9. A bookmark and page holding device comprising:

a means for attachment to a book;

a swing arm having a first end pivotally connected to said means for attachment, said first end being pivotable about a first axis, said swing arm also having a second end distal to said first end;

means for spring-loading said swing arm relative to said means for attachment;

a yoke having a first end pivotally connected to said second end of said swing arm, said yoke being pivotable about a second axis, said second axis lying parallel to and co-planar with said first axis, said yoke also having a second end distal to said first end of said yoke, and said yoke being limited in its pivotable movement relative to said second end of said swing arm by a rotation limiting means; and a page holder plate pivotally connected to said second end of said yoke, said page holder plate being pivotable about a third axis being perpendicular to said second axis and lying in a plane parallel to said plane defined by the page tops of said book, wherein said rotation limiting means comprises:

said second end of said swing arm;

said yoke having a notched portion with a first and second limiting surface;

said second end having a protrusion from said planar surface extending into said notched portion, whereby the rotation of said yoke is limited at one extreme by the contact of said protrusion with said first limiting surface of said notched portion and at the other extreme by the contact of said protrusion with said second limiting surface of said notched portion.

10. A bookmark and page holding device comprising:

a means for attachment to a book;

a swing arm having a first end pivotally connected to said means for attachment, said first end being pivotable about a first axis, said swing arm also having a second end distal to said first end;

means for spring-loading said swing arm relative to said means for attachment;

a yoke having a first end pivotally connected to said second end of said swing arm, said yoke being pivotable about a second axis, said second axis lying parallel to and co-planar with said first axis, said yoke also having a second end distal to said first end of said yoke, and said yoke being limited in its pivotable movement relative to said second end of said swing arm by a rotation limiting means; and a page holder plate pivotally connected to said second end of said yoke, said page holder plate being pivotable about a third axis being perpendicular to said second axis and lying in a planar parallel to said plane defined by the page tops of said book, wherein said rotation limiting means comprises:

said second end of said swing arm;

said yoke having oppositely facing first and second notched portions;

said second end of said swing arm having first and second protrusions extending into said first and second notched portions, whereby the rotation of said yoke is limited at one extreme by the contact of said first protrusion with said first notched portion and at the other extreme by the contact of said second protrusions with said second notched portion.

* * * * *